US005092207A

United States Patent [19]

Kikuchi et al.

[11] Patent Number: 5,092,207

[45] Date of Patent: Mar. 3, 1992

[54] FIBER BUNDLE CUTTING DEVICE

[75] Inventors: Toshiaki Kikuchi; Tomoko Fujita, both of Fukushima, Japan

[73] Assignee: Nitto Boseki Co., Ltd., Fukushima, Japan

[21] Appl. No.: 558,452

[22] Filed: Jul. 27, 1990

[30] Foreign Application Priority Data

Jul. 31, 1989 [JP] Japan ..... 1-198226

[51] Int. Cl.[5] ..... B26D 1/62; B26D 7/18

[52] U.S. Cl. ..... 83/116; 83/347; 83/913

[58] Field of Search ..... 83/116, 114, 117, 347, 83/913

[56] References Cited

U.S. PATENT DOCUMENTS 3,555,947 1/1971 Fram ..... 83/116
4,063,479 12/1977 Roncato ..... 83/117
4,253,363 3/1981 Fram ..... 83/114
4,406,196 9/1983 Roncato ..... 83/117

FOREIGN PATENT DOCUMENTS 767650 3/1953 Fed. Rep. of Germany .
55-42220 3/1980 Japan .
547360 3/1974 Switzerland .

*Primary Examiner*—Douglas D. Watts
*Assistant Examiner*—C. Dexter
*Attorney, Agent, or Firm*—Sixbey, Friedman, Leedom & Ferguson

[57] ABSTRACT

A fiber bundle cutting device is disclosed which includes an elastic roller; a cutting roller having a plurality of thin plate-like cutter blades extending radially therefrom, the cutter roller being disposed in parallel relation with the elastic roller in such a manner that the cutter blades can be slightly pressed against a surface of the elastic roller; a plurality of push-out members each movably mounted between a respective pair of the cutter blades and disposed adjacent to one another; and ring members respectively holding the opposite ends of each of the push-out members to maintain the push-out members in a generally cylindrical configuration; the ring members and the push-out members held by the ring members being movable to an eccentric position relative to the cutter roller so as to progressively move from the proximal to the distal edge of the cutting blades during the operation of the cutting device to discharge the cut pieces of a fiber bundle.

19 Claims, 2 Drawing Sheets

FIBER BUNDLE CUTTING DEVICE

TECHNICAL FIELD

This invention relates to a fiber bundle cutting device provided With a cutter roller having a plurality of radially-extending cutter blades, and more particularly to a fiber bundle cutting device capable of preventing clogging of the spaces between the cutter blades.

BACKGROUND OF THE INVENTION

Conventional devices for cutting a bundle of fibers such as a strand or tow of inorganic fibers such as glass fiber have used a cutter roller which comprises a rotatable cylindrical body having a plurality of radial grooves formed in the outer periphery of the cylindrical body and extending longitudinally along the cylindrical body, and relatively thin plate-like cutter blades each being mounted in a respective groove. The cutter roller is disposed with respect to an elastic roller, having an elastic member formed of urethane rubber or the like mounted about an outer periphery thereof, in such a manner that the axes of rotation of the two rollers are parallel to one another, and that the distal ends of the cutter blades mounted on the cutter roller slightly press against the surface of the elastic roller. During the rotation of the cutter roller, the bundle of fibers is passed between the area of contact between the cutter blades of the cutter roller and the elastic roller, so that the cutter blades and the elastic roller cooperate to cut the fiber bundle, thus producing cut fibrous materials of a length corresponding to the interval between the cutter blades.

However, in cutting devices of this type, the width of the mounting groove for receiving the cutter blade is intentionally designed to be large in order to provide a gap between the groove and the cutter blade. The blade is thus movable within this gap. Therefore, with such so-called rattling cutter blades, clogging of the cut material between the blades is less likely to occur, because the fibrous material jammed in between the cutter blades is discharged by the centrifugal force of the cutter roller. However, if this centrifugal force is not of a sufficient degree, the fibrous material may not be discharged, thus resulting in the fibrous material being clogged between the blades. To obtain a sufficient centrifugal force, the cutter roller must be rotated at high speeds, and for this reason the component parts of the cutter roller must be of a high precision. Further, the service life of the rattling cutter blade is shortened due to fatigue failure, and also the load on the machine body is increased, which may lead to a malfunction. Additionally, since the cut fibrous material is discharged from the space between the cutter blades at a high speed, the fiber bundle may become napped or loosen. This may adversely affect the quality of the product.

When it is intended to obtain fibrous material which is cut to a short length, the interval between the cutter blades is small, and therefore the cut fiber bundle is more likely to become jammed in between the cutter blades. Further, when cutting a thick bundle composed of an increased number of fibers, the fiber bundle is pushed deep into the space between the cutter blades during the cutting operation, and therefore the cut fiber bundles accumulate up to the distal ends of the cutter blades. An imperfect cutting by the cutter blade may then be encountered.

Various proposals have been made for preventing the clogging of the cutter by such cut fiber bundles. For example, as disclosed in Japanese Patent Unexamined Publication No. Sho. 55-42220, a wire is extended between cutter blades, and the cutter blade is brought into contact with a rubber roller for effecting the cutting. When the contact between the cutter blade and the rubber roller is released, the cut piece is discharged due to the resiliency of the wire. However, the fiber bundle is pressed against the rubber roller by the wire, and therefore in a direct cutting operation in which a glass fiber strand is formed by spinning and cut immediately after the sizing, a bundle of fibers in a wet condition will be pressed by the wire and may be deformed, and further the cut fiber bundle may adhere to the surface of the rubber roller. This results in several disadvantages such as the deformation of the fiber bundle when the adhered bundle is separated from the rubber roller, a nap may be created due to dispersion, or the generation of short fibers due to a re-cutting of the cut fiber bundle. Further as is disclosed in U.S. Pat. No. 4063479, a bar is provided between the cutter blades of a cutting device, and the bar is moved inwardly and outwardly between the cutter blades by partially deforming an elastic ring molded of an elastic material such as polyethylene elastomer, so that the cut piece is discharged exteriorly due to the restoring force of the deformed elastic material. This device also has similar shortcomings as with the previous device. Also, time and labor are required to assemble this device for pushing the cut fiber bundle out of the space between the cutter blades.

Therefore, there is clearly a need for a cutting device which is capable of readily discharging the cut fibrous material from between the cutting blades.

SUMMARY OF THE INVENTION

It is an object of the present invention to provide a fiber bundle cutting device which overcomes the shortcomings associated with the above-described devices and which is highly effective in preventing the jamming of the cut piece within the cutting device.

Another object of the present invention is to provide a fiber bundle cutting device which reduces the deformation of cut fiber bundles when the cutting device is applied in a direct cutting operation.

Yet a further object of the present invention is to provide a fiber bundle cutting device which is capable of being easily manufactured and readily installed in fiber bundle cutting operations.

The above objects are achieved in accordance with the present invention by providing a fiber bundle cutting device comprising an elastic roller; a cutting roller having a plurality of thin plate-like cutter blades extending radially therefrom, the cutter roller being disposed in parallel relation with the elastic roller in such a manner that the cutter blades can be slightly pressed against a surface of the elastic roller; a plurality of push-out members each movably mounted between a respective pair of the cutter blades and disposed adjacent to one another; and ring members respectively holding the opposite ends of each of the push-out members to maintain the push-out members in a generally cylindrical configuration; the ring members and the push-out members held by the ring members being movable to an eccentric position relative to the cutter roller.

Preferably, each of the ring members comprises a movable inner peripheral ring and a movable outer peripheral ring radially spaced from the inner peripheral ring, the push-out members being held between the movable inner peripheral ring and the movable outer peripheral ring so as to move in the direction of the circumference of the ring member.

Preferably, the above fiber bundle cutting device is provided with a ring position-limiting member for limiting the position of rotation of the ring members to an eccentric position relative to the cutter roller.

During the operation of the fiber bundle cutting device, the cutter roller and the elastic roller are rotated, and the fiber bundle fed between the two rollers is cut by the cutter blades of the cutter roller. At the time of this cutting operation, the push-out member disposed at the cutting position is pushed or urged inwardly of the cutter blades by the fiber bundle; however, since a number of push-out members are maintained in a cylindrical configuration by the ring members, the cylinder constituted by the push-out members is moved parallel as a whole, and is held or maintained in an eccentric position relative to the cutter roller. Therefore, as the push-out member moves away from the cutting position, the push-out member is positively displaced toward the distal ends of the cutter blades between the cutter blades, thereby pushing out the fiber bundle jammed between the cutter blades.

If the push-out members are designed to be movable relative to the ring members in the circumferential direction as described above, the pitch of the push-out members will be suitably varied during the rotation of the push-out members. Therefore, push-out members of a relatively large width can be used even if the interval between the cutter blades is small, thus increasing the strength of the push-out members.

Further, by providing the above-described construction, the cylinder constituted by the push-out member is maintained in its eccentric position by the ring position-limiting member, thus the push-out member will not press the fiber bundle against the elastic roller when cutting the fiber bundle. Therefore, even when cutting a fiber bundle having a binder which is not yet dry as in a direct cutting operation, the cut fiber bundle will be subjected to a lesser degree of deformation, thus enabling a precise cutting without allowing the fiber bundle to adhere to the surface of the rubber roller.

DETAILED DESCRIPTION OF THE PREFERRED EMBODIMENTS

Figure 1:
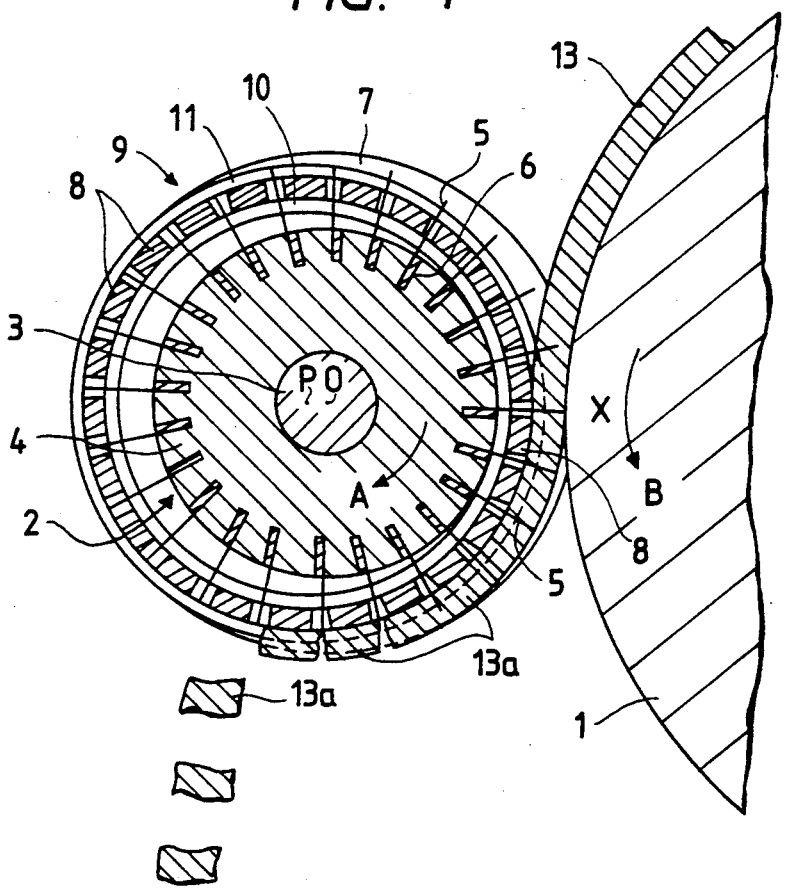
FIG. 1 is a schematic cross-section view of a fiber bundle cutting device according to the present invention.
Figure 2:
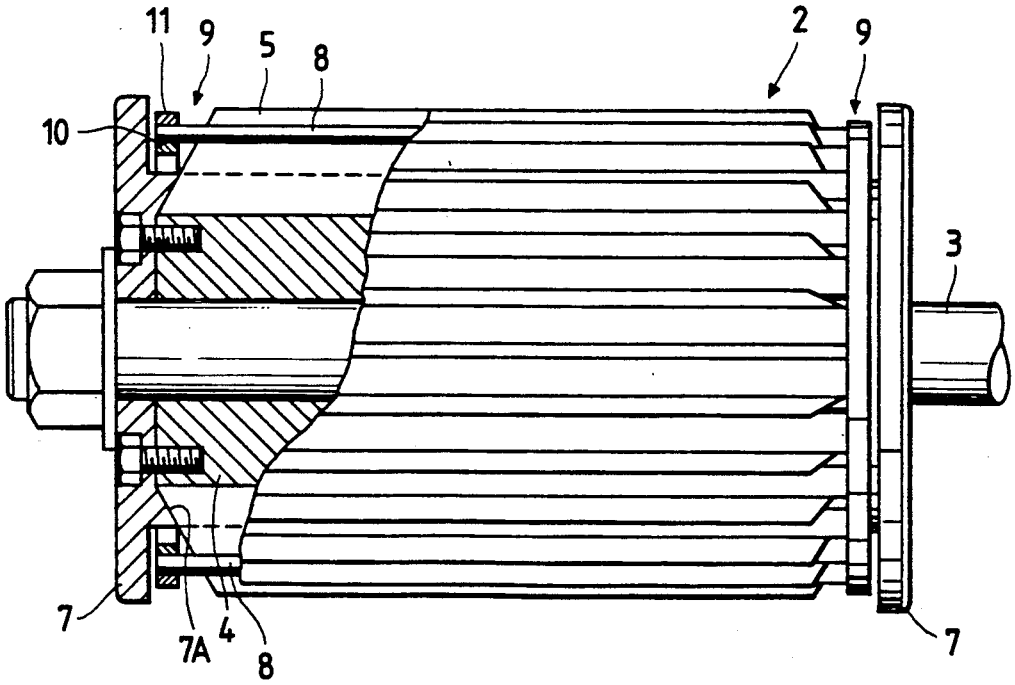
FIG. 2 is a partial cross-sectional, side-elevational view of a cutter roller of the cutting device incorporating a cut material-removing mechanism, as viewed from the side of an elastic roller.

The invention will now be described in detail with reference to the several FIGURES. As is illustrated in FIGS. 1 and 2, the fiber bundle cutting device comprises an elastic roller having an outer peripheral surface constituted by urethane rubber or the like, and a cutter roller 2 disposed close to the elastic roller 1 and in parallel relationship thereto to form a cutting nip therebetween. The cutter roller 2 comprises a cutter body 4 fixedly mounted on a cutter roller shaft 3 rotatably driven by a drive device (not shown). A plurality of radially-extending thin plate-like cutter blades 5 are inserted in radial grooves formed in the outer peripheral surface of the cutter body 4, spacers 6 are inserted in these grooves to fix each of the cutter blades 5 with respect to the cutter body 4, and flanges 7 are fixedly mounted on the opposite ends of the cutter body 4. As can best be seen from FIG. 2, the opposite ends of each of the cutter blades 5 are inclined in such a manner that the proximal portion thereof is wider than the distal portion. The flanges 7 include tapered surfaces 7A which correspond to the respective inclined opposite ends of the cutter blade 5. This engagement of the tapered surfaces 7A which contact the inclined ends of the cutter blades 5 prevent the cutter blades 5 from jumping out of place. The elastic roller 1 and the cutter roller 2 are positioned relative to one another in such a manner that the distal ends of the cutter blades 5 of the cutter roller 2 can be brought into slight contact with the surface of the elastic roller 1.

A cut material removing mechanism for removing fibers which protrude into the spaces between the cutter blades 5 during the cutting operation is provided on the cutter roller 2. The cut material-removing mechanism comprises a number of push-out members 8 each movably mounted between an adjacent pair of cutter blades 5. Ring members 9 are provided for holding the opposite ends of the push-out members 8 and maintaining the push-out members 8 in a cylindrical configuration. In this embodiment, the ring member 9 includes a movable inner peripheral ring 10 and a movable outer peripheral ring 11 disposed in radially spaced relation to the inner peripheral ring 10. In the embodiment shown in FIGS. 1–2, the rings are movable with respect to the cutting roller. Accordingly, a force applied to the rings or the push-out members associated with the rings, will cause movement of the ring members and the cylindrical configuration of the push-out members with respect to the cutting roller. The spacing between the outer surface of the movable inner peripheral ring 10 and the inner surface of the movable outer peripheral ring 11 is slightly greater than the thickness of the push-out member 8, and the opposite ends of each push-out member 8 are received in these two spaces, respectively. The push-out members 8 are thus supported for movement in the circumferential direction relative to rings 10 and 11. A plurality of push-out members 8 are arranged in a cylindrical configuration by the movable inner peripheral ring 10 and the movable outer peripheral ring 11. The inner diameter of the movable outer peripheral ring 11 is so determined that the outer diameter of the cylindrical shape constituted by a number of push-out members 8 is substantially equal to or less then the diameter of the circle generated by the distal end of each of cutter blades 5. The ring member 9 constituted by the movable inner peripheral ring 10 and the movable outer peripheral ring 11 is movable relative to the cutter roller 2 in a plane perpendicular to the axis of rotation thereof, and therefore is movable to an eccentric position relative to the cutter roller 2. The cross-sectional shape of the push-out members 8 may take any suitable shape such as a thin plate-shape, an arcuate shape, an oval shape, a rectangular shape, or a rectangular shape with tapered corners. The material from which the push-out members 8 are formed may be any material such as metal, GFRP, CFRP and the like so long as it has a rigidity and an impact-resistance sufficient to discharge the cut fibrous material.

The flanges 7 are of a greater outer diameter than the movable outer peripheral ring 11, and function to restrict the movement of the movable outer peripheral ring 11, the movable inner peripheral ring 10, the push-out members 8. During the operation of the fiber bundle cutting device, an axis of rotation of the ring member 9 is disposed in a plane defined by the axis of rotation of the cutter roller 2 and a cutting portion X as best shown in FIG. 1.

The cutting operation of the fiber bundle cutting device having the above construction will now be described in greater detail The cutter roller 2 is rotated by a drive device (not shown) in a direction indicated by arrow A, and in response thereto, the elastic roller 1 is also rotated in a direction indicated by arrow B as shown in FIG. 1. During this rotation, a fiber bundle 13 to be cut is supplied to the elastic roller 1, and is fed by the elastic roller 1 between the elastic roller 1 and the cutter roller 2, so that the fiber bundle 13 is cut by the plurality of cutter blades 5 mounted about the periphery of the cutter roller 2. As the fiber bundle 13 approaches the cutting position X where the cutting is effected by the cutter blade 5, the fiber bundle 13, while being cut, pushes or urges the push-out member 8 inward between the cutter blades 5. The push-out members 8 which are held at their opposite ends by the movable inner peripheral ring 10 and the movable outer peripheral rings 11 are maintain in a cylindrical configuration as a whole, and therefore when the push-out members 8 in the vicinity of the cutting position X are urged by the fiber bundle 13 toward the axis 0 of rotation of the cutter roller 2, the remaining plurality of push-out members 8 are also moved. As a result, the axis P (the centers of the rings 10 and 11) of rotation of the cylinder formed by the plurality of push-out members 8 is displaced from the axis 0 of rotation of the cutter roller 2 in a direction away from the elastic roller 1. Therefore, the cylinder formed by the push-out members 8 is disposed in an eccentric relationship with respect to the circle generated by the distal ends of the cutter blades 5. As described above, the outer diameter of the cylinder constituted by the push-out members 8 is substantially equal to the circle generated by the distal ends of the cutter blades 5, and therefore when the push-out member 8 is pushed inwardly of the distal end of the cutter blade 5 at the cutting position X. the push-out member 8 disposed at the diametrically opposite position is extended outwardly of the distal ends of the cutter blades 5.

The cutter roller 2 is continuously rotated, and the fiber bundle 13 is continuously cut. During this time, in response to this rotation, the push-out members 8 are also rotated about the axis of rotation. The push-out member 8, urged by the fiber bundle 13 inwardly between the cutter blades 5 at the cutting position X is then rotated in the direction of arrow A, and is gradually displaced outwardly between the cutter blades 5 as it moves away from the cutting position X, and finally is displaced outwardly of the distal ends of the cutter blades 5. Therefore, the cut portion 13*a* of the fiber bundle in the space between the cutter blades 5 is gradually pushed out by the push-out member 8, and is positively discharged from the space between the cutter blades 5.

Figure 5:
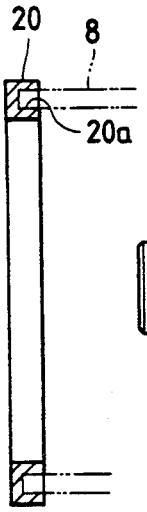
FIG. 5 is a cross-sectional view of a modified ring member.

In a modification of the above embodiment, the movable outer peripheral ring 11 and movable inner peripheral ring 10 may be replaced by a movable ring 20 illustrated in FIG. 5. The ring 20 is of a channel-shaped cross-section having an annular groove 20*a* in Which the push-out members 8 are held for movement in the circumferential direction. Although the push-out members 8 are held in the ring members 9 or ring 20 for movement in the circumferential direction, the invention is not limited to such an arrangement, and the push-out members 8 may be fixed relative to the ring members 9 or ring 20. In such a case, there is no need to use an inner or outer ring, that is, the movable inner peripheral ring and the movable outer peripheral ring, may be replaced with a single ring. Further, the plurality of push-out members 8 and the ring members 9 provided respectively at the opposite ends of the push-out members 8 may be of an integral construction. For example, a number of wide slits can be formed in an annular pipe the width of which is longer in length than that of the cutter blades 5 so that the cutter blades extend through the slits, thereby providing a number of push-out members and the ring member as an integral constructions.

Although the push-out members 8 may be fixed relative to the ring members 9 as described above, the following advantage can be obtained when the push-out members 8 are movable relative to the ring members 9 in the circumferential direction as in the above embodiment. When the cutter blades 5 and the push-out members 8 are rotated in eccentric relation to one another as shown in FIG. 1, the circumferential distance between the cutter blades 5 is smaller at the cutting position X, where the push-out member 8 is disposed inwardly of the distal ends of the cutter blades 5. Further, it is preferred that the distance or pitch between the adjacent push-out members 8 be small in this region. On the other hand, it is preferred that the interval between the adjacent pushout members 8 at the diametrically opposite side be large. In this embodiment, since the push-out member 8 is movable relative to the ring members 9 in the circumferential direction, the pitch of the push-out members 8 may be changed during the movement of the ring members 9. Moreover, even if the push-out member is wide, it will not interfere with the cutter blades 5. If the pitch of the push-out members 8 in the circumferential direction is fixed, it will be necessary that the distance between the adjacent push-out members 8 be sufficiently large so that it may not interfere with the cutter blades 5 during the rotation of the push-out members 8. In other words, the push-out members 8 must be narrow. When it is desired to cut the fiber bundle into a short length, the cutter blades 5 must be positioned circumferentially close to one another. Therefore, the push-out member 8 must be even more narrow, consequently the push-out member 8 will be flexed considerably because of its lack of rigidity and thus may not push out cut fibrous material which is tightly fitted between the cutter blades. However, when the pitch of the push-out members 8 can vary in the circumferential direction as in this embodiment, push-out members 8 of a greater width can be used as compared with the case where the pitch is fixed. Consequently, the strength of the push-out members 8 can be increased, thus the cut fiber bundle can be positively discharged.

Figure 3:
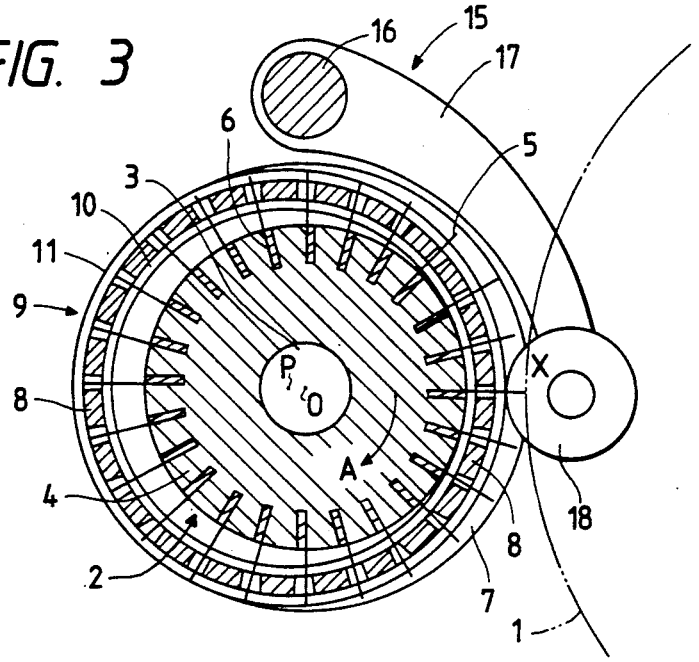
FIG. 3 is a schematic cross-sectional view of a modified fiber bundle cutting device of the invention.
Figure 4:
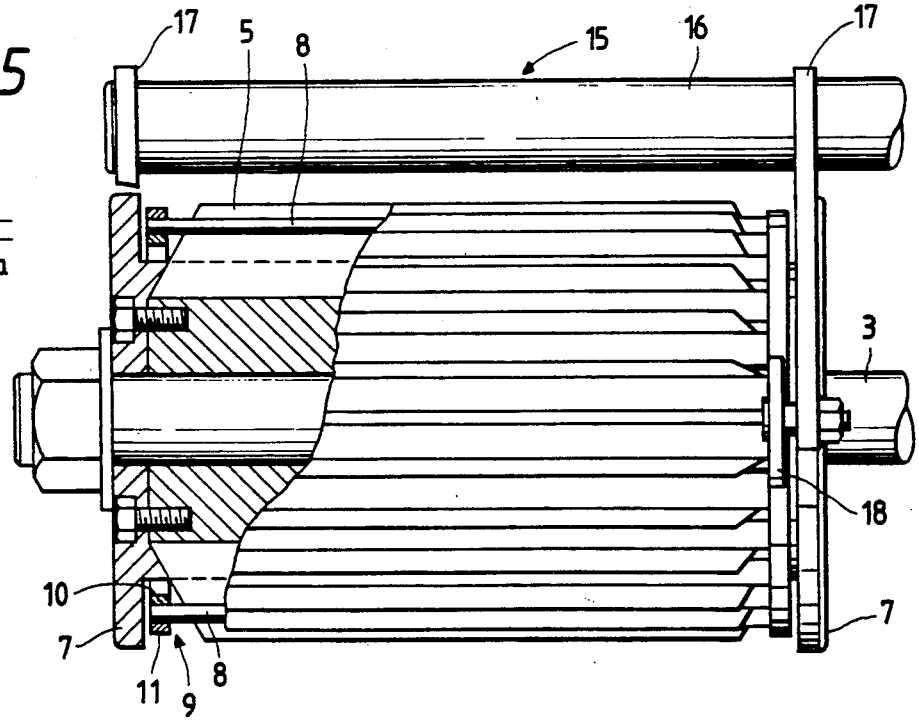
FIG. 4 is a partial cross-sectional, side-elevational view of the modified device.

FIGS. 3 and 4 illustrate an alternative embodiment showing the fiber bundle cutting device in accordance with the present invention which is capable of readily cutting fibrous material in a direct cutting operation. In this embodiment, a ring position-limiting member 15 is added to the fiber bundle cutting device illustrated in FIG. 1. The ring position-limiting device 15 serves to limit the position of rotation of the movable outer peripheral rings 11, mounted respectively on the opposite ends of the cutter roller 2, to a predetermined eccentric position relative to the cutter roller 2. The ring position-limiting member 15 includes a holder shaft 16, a pair of holder arms 17 mounted on the holder shaft 16, and holders 18 rotatably mounted on the distal ends of the holder arms 17. The holder shaft 16 is rotated to the position illustrated in FIG. 3, and is maintained in this position, so that the holders 18 urge the respective movable outer peripheral rings 11 toward the axis 0 of rotation of the cutter roller 2. This, in turn, maintains the cylinder, constituted by the push-out members 8, at a position in which the axis P of rotation of this cylinder is disposed in eccentric relationship with respect to the cutter roller 2. In this embodiment, the fiber bundle is not pressed by the push-out members 8 against the elastic roller and therefore even when cutting the fiber bundle whose binder has not yet dried, the cut fibrous material will not adhere to the surface of the elastic roller 1. Additionally, when using the ring position-limiting member 15, the width of the elastic roller 1 or the arrangement of the elastic roller 1 is determined such that the elastic roller will not interfere with the holders 18 and the holder arms 17. In this embodiment, the width of the elastic roller 1 is smaller than that of the cutter blade 5.

Although, as illustrated in FIG. 3, the ring position-limiting member 15 includes rotatable holders 18, these holders may be replaced by block-like holders made of bearing metal or the like. Further, although the ring position-limiting member 15 urges the corresponding movable outer peripheral ring 11 toward the axis 0 of rotation of the cutter roller 2 at the cutting position X, the invention is not restricted to such a construction, and the position and number of position-limiting holders 18 can be suitably varied. Further, the inner surface of the movable inner peripheral ring may be limited to a predetermined position by any suitable member.

The fiber bundle cutting device, when performing a direct cutting operation, operates in the following manner. For purposes of example, three strands of fiber were spun in a conventional manner from three bushings each having 2000 tip nozzles and cooling fins. The fibers were bundled by an ordinary binder agent containing an adhesive and a lubricant. The bundled three strands were fed between the elastic roller 1 and the cutter blades 5 which are brought into pressing contact with the elastic roller 1, the cutter blades 5 being spaced from one another a circumferential distance or interval of 5 mm. The position of each holder 18 was so adjusted that the push-out member 8 disposed at the cutting position X was spaced a distance of 2 mm from the surface of the elastic roller 1. The cutting of the fiber bundle was carried out with the peripheral speed of the elastic roller 1 at 1000 m/min. The operation was continued for eight hours. No clogging of the cutter blades was observed during this operation. Further, since the fiber bundle was not subjected to pressure when it was cut, the cut pieces of the fiber bundle, when dried, did not exhibit any deformation or cracks, and exhibited good flowing properties.

As is clear from the foregoing, with the cutting device of the present invention, the push-out members 8 disposed between adjacent cutter blades 5 are held by the ring members 9 in a generally cylindrical shape, with the ring members 9 and the push-out members 8 being eccentrically positioned relative to the cutter roller 2. With this construction, the cylinder : constituted by the push-out members 8 can be maintained by the fiber bundle 13 to be cut in eccentric position relative to the cutter roller 2. As the push-out members 8 move away from the cutting position X, the push-out members 8 are positively displaced toward the distal ends of the cutter blades 5, thereby positively pushing out the fiber bundle 13*a* jammed between the cutter blades 5. Further, since the cut materials are discharged without relying on centrifugal force, generated by the rotation of the cutting roller 2, the discharge of the fiber bundle can be positively effected even when the peripheral speed is low, thus resulting a precisely cut bundle.

Further, since the push-out members 8 and the ring members 9 are movable relative to the cutter roller 2, the construction is maintained relatively simple, such that the probability of a mechanical malfunction is reduced and the time and complexity of repairing the system is also reduced.

Further, if the push-out members 8 are designed to be movable relative to the ring members 9 in the circumferential direction, the pitch of the push-out members 8 may be suitably varied during the rotation of the push-out members 8. Therefore, the push-out members 8 of a relative large width can be used even if the interval between the cutter blades 5 is small, thus increasing the strength of the push-out members 8.

Additionally, if the construction is such that the cylinder constituted by the push-out members 8 is maintained at the eccentric position by the ring position-limiting members 15, the push-out members 8 will not press the fiber bundle 13 against the elastic roller 1 when cutting the fiber bundle, and therefore even when cutting the fiber bundle 13 having a binder which is not yet dry as in direct cutting, the cut fiber bundle is less subjected to deformation and cracking, and will be less likely to adhere to the elastic roller 1.

The fiber bundle cutting device in accordance with the present invention may be used for cutting a strand or sheet of inorganic fibers such as glass fibers, pitch fibers or carbon fibers, and is particularly suited for a low-speed cutting involving a relatively low centrifugal force.

While the present invention has been described with reference to preferred embodiments, it will be appreciated by those skilled in the art that the invention may be practiced otherwise than as specifically described herein without departing from the spirit and scope of the invention It is, therefore, to be understood that the spirit and scope of the present invention be limited only by the appended claims.

We claim:

1. A fiber bundle cutting device comprising:

an elastic roller;

a cutter roller positioned to form a cutting nip with said elastic roller, said cutter roller having a plurality of cutting blades extending radially therefrom;

a plurality of push-out members, each push-out member being movably mounted between a respective adjacent pair of cutting blades; and ring members for receiving opposing ends of each of said push-out members and maintaining said plurality of push-out members in a generally cylindrical configuration said ring members being mounted to rotate with the cutter roller and to move relative to the cutter roller in a direction substantially perpendicular to a cutter roller axis such that;

said cylindrical configuration is moved to an eccentric position relative to the axis of said cutter roller by a force applied substantially radially to the cylindrical configuration and in the vicinity of the cutting nip during a cutting operation.

2. The device as defined in claim 1, wherein said axis of rotation of said cutter roller and an axis of rotation of said elastic roller are substantially parallel.

3. The device as defined in claim 1, wherein said cutter roller is positioned such that said cutter blades contact a surface of said elastic roller.

4. The device as defined in claim 1, wherein each of said ring members comprise a movable inner peripheral ring and a movable outer peripheral ring, and said push-out members are held between said movable inner peripheral ring and said movable outer peripheral ring so as to move in a direction of a circumference of said ring member.

5. The device as defined in claim 1, further comprising a ring position-limiting means for maintaining said ring members in said eccentric position relative to said axis of said cutter roller.

6. The device as defined in claim 5, wherein said ring position-limiting means includes at least one contacting means for contacting at least one of said ring members to maintain said ring members in said eccentric position.

7. The device as defined in claim 6, wherein said contacting means is a roller which contacts an outer periphery of said ring member.

8. The device as defined in claim 6, wherein there are two contacting means, each contacting one of said ring members.

9. A fiber bundle cutting device comprising:

an elastic roller;

a cutter roller positioned to form a cutting nip with said elastic roller, said cutter roller having a plurality of cutting blades extending radially therefrom;

a plurality of push-out members, each push-out member being movably mounted between a respective adjacent pair of cutting blades; and ring members for receiving opposing ends of each of said push-out members and maintaining said plurality of push-out members in a generally cylindrical configuration;

wherein said cylindrical configuration is eccentrically positioned relative to an axis of said cutter roller and each of said ring members is arranged to allow said push-out members to move relative to said ring members in a direction of a circumference of said ring members.

10. The fiber bundle cutting device of claim 9, wherein said ring members are mounted to rotate with the cutter roller and to move relative to the cutter roller in a direction substantially perpendicular to a cutter roller axis such that said cylindrical configuration is moved to an eccentric position relative to the axis of said cutter roller by a force applied substantially radially to the cylindrical configuration and in the vicinity of the cutting nip during a cutting operation.

11. The device of claim 10, wherein each of the ring members comprise a movable inner peripheral ring and a movable outer peripheral ring, and said push-out members are held between said movable inner peripheral ring and said movable outer peripheral ring so as to move in a direction of a circumference of a said ring member.

12. The device of claim 10, further comprising a ring position-limiting means for maintaining said ring members in said eccentric position relative to said axis of said cutter roller.

13. The device of claim 12, wherein said ring position-limiting means includes at least one contacting means for contacting at least one of said ring members to maintain said ring members in said eccentric position.

14. The device of claim 13, wherein said contacting means includes a roller which contacts an outer periphery of said ring member.

15. The device of claim 13, wherein two contacting means are provided, each contacting one of said ring members.

16. The device of claim 10, further comprising a ring position-limiting means for maintaining said ring members in an eccentric position relative to the axis of the cutter roller, wherein said ring members rotate relative to said ring position-limiting means, said ring position-limiting means including at least one contacting means for contacting at least one of said ring members along an outer periphery thereof as said ring members rotate relative to said ring position-limiting means to maintain said ring members in said eccentric position.

17. The device of claim 9, wherein an axis of rotation of said cutter roller and an axis of rotation of said elastic roller are substantially parallel.

18. The device of claim 9, wherein said cutter roller is positioned such that said cutter blades contact a surface of said elastic roller.

19. The fiber bundle cutting device comprising:

an elastic roller;

a cutter roller positioned to form a cutting nip with said elastic roller, said cutter roller having a plurality of cutting blades extending radially therefrom;

a plurality of push-out members, each push-out member being movably mounted between a respective adjacent pair of cutting blades; and ring members for receiving opposing ends of each of said push-out members and maintaining said plurality of push-out members in a generally cylindrical configuration;

wherein said cylindrical configuration is eccentrically positioned relative to an axis of said cutter roller and the device further comprises a ring position-limiting means for maintaining said ring members in said eccentric position relative to said axis of said cutter roller, wherein said ring members rotate relative to said ring position-limiting means, said ring position-limiting means including at least one contracting means for contacting at least one of said ring members along an outer periphery thereof as said ring members rotate relative to said ring position limiting means to maintain said ring members in said eccentric position.

* * * * *